US005312057A

United States Patent [19]

Graham

[11] Patent Number: 5,312,057

[45] Date of Patent: May 17, 1994

[54] CABLE DISPENSING DEVICE WITH MEANS FOR LIFTING AND CONVEYING REEL AND METHOD

[76] Inventor: Ronald G. Graham, P.O. Box 524, St. Clair, Mich. 48079

[21] Appl. No.: 744,390

[22] Filed: Aug. 13, 1991

[51] Int. Cl.[5] ..... B66B 11/04; B65H 19/30

[52] U.S. Cl. ..... 242/54 R; 242/58.6

[58] Field of Search ..... 242/54 R, 58.6, 79, 242/55

[56] References Cited

U.S. PATENT DOCUMENTS

| | | | |
|---|---|---|---|
| 2,508,566 | 5/1950 | Dunton | 242/58.6 |
| 2,904,273 | 9/1959 | Turner, Jr. et al. | 242/54 R |
| 2,973,914 | 3/1961 | Beninger et al. | 242/58.6 |
| 3,099,117 | 7/1963 | Christiansen | 242/58.6 |
| 3,325,118 | 6/1967 | Hall | 242/58.6 |
| 4,088,277 | 5/1978 | Councell | 242/58.6 |
| 4,204,663 | 5/1980 | Baughn et al. | 242/58.6 |
| 4,887,774 | 12/1989 | Phillips et al. | 242/58.6 |

*Primary Examiner*—Daniel P. Stodola
*Assistant Examiner*—John F. Rollins
*Attorney, Agent, or Firm*—Remy J. VanOphem

[57] ABSTRACT

A cable dispensing apparatus for dispensing a length of cable from a payout reel to a take-up reel. The cable dispensing apparatus has a transfer system which both lifts and moves the payout reel to a predetermined distance from the operator without requiring the operator to travel between the front and backside of the cable dispensing apparatus. The apparatus is equipped such that the operator can remain between the cable dispensing apparatus and a cable cutting apparatus which collects the cable onto the take-up reel. The cable dispensing apparatus positions the payout reel at the predetermined distance such that the free end of the cable is within arm's length of the operator. The cable dispensing apparatus includes a frame from which a pair of support arms extend rearwardly in a direction opposite the operator. The support arms are rotatably attached to the frame and have support devices mounted thereto which can be translated along the length of the support arms for moving the payout reel away from or toward the operator. The cable dispensing apparatus preferably includes a sensing device for sensing when the payout reel has been sufficiently translated toward the operator so as to be the predetermined distance from the operator. The cable dispensing apparatus further includes a drive motor for rotating the payout reel and a positioning device for moving the arms toward and away from each other so as to accommodate reels of differing widths.

12 Claims, 3 Drawing Sheets

CABLE DISPENSING DEVICE WITH MEANS FOR LIFTING AND CONVEYING REEL AND METHOD

BACKGROUND OF THE INVENTION

1. Field of the Invention

The present invention generally relates to a dispensing apparatus. More specifically, this invention relates to a cable dispensing apparatus for dispensing cables, such as electrical cable, telephone cable wire, and the like from large reels wherein the apparatus is capable of positioning the payout reel both vertically and horizontally to facilitate removal of the cable by an operator for subsequent measurement and cutting operations associated with transferring a specific length of the cable to a take-up reel.

2. Description of the Prior Art

In the broadest sense, the function of cable handling equipment is to dispense and measure a given length of cable as necessitated by the demands of a particular application. Because cable is generally purchased in bulk on large reels weighing as much as 20,000 pounds, it is generally also necessary that the cable handling equipment be capable of transferring the cable from a very large reel, as provided by the manufacturer, to a smaller reel which the end user can more easily transport for field applications and handle for use in manufacturing applications. This is particularly true where the cable is very large and bulky, such as telephone cable installed in the field by the telephone industry.

An example of cable handling equipment known in the prior art is illustrated in FIG. 1. A cable dispensing unit 110, shown in a group of four units, is provided onto which a large reel 116 is rotatably secured by an axle 124. The axle 124 is mounted to reel supports 122 which are constructed to be able to suspend the large reel 116 above the floor. Cable 120 is dispensed from the large reel 116 and, conventionally, fed to a cable cutting unit 112 for measuring and cutting the desired length of cable 120 needed for a particular application. In order to be cost-efficient, the cable cutting unit 112 is typically assigned to a group of four cable dispensing units 110, as shown in FIG. 1, though a single unit can also be employed where desired. Accordingly, it is necessary to mount the cable cutting unit 112 on a rail or otherwise make the cable cutting unit 112 movable in front of the group of cable dispensing units 110 to enable the cable cutting unit 112 to be positioned directly in front of a particular cable dispensing unit 110. This operation requires an operator 126 who normally operates the cable cutting unit 112 and positions the cable cutting unit 112 as required. The operator 126 typically has additional tasks when operating the cable dispensing units 110 of the prior art, as will be explained more fully below. Once fed through the cable cutting unit 112 and cut to the desired length, the cable 120 is collected onto a take-up reel 114 for transporting the cable 120 to the job site.

The cable 120 is generally purchased by the user on a large reel 116, referred to as a payout reel, to allow cost-efficient bulk purchases. Consequently, the payout reels 116 are extremely heavy and awkward to handle and the cable dispensing unit 110 must be adequately suited for such conditions. Because the payout reels 116 are available in various sizes typically ranging from 42 to 96 inches in diameter, the cable dispensing unit 110 must also be able to accept variations in weight and reel diameter. Accordingly, the reel supports 122 of the cable dispensing unit 110 must be able to move vertically to ensure that payout reels 116 of most conventional sizes will be sufficiently lifted off the ground so that they can rotate freely to dispense the cable 120. Such operation requires a suitable system for actuating the reel supports 122 between a lower position for loading the payout reel 116 and a raised position for dispensing the cable 120. Typically a hydraulic actuation system (not shown) is employed because of its suitability to manufacturing conditions. Alternatively, a forklift can be employed to lift the payout reel 116 to the reel supports 122, but due to the size and weight of the payout reel 116 such approach can be awkward and dangerous.

In the typical cable dispensing unit 110, the hydraulic system is stowed in a cabinet 118 on the side of the cable dispensing unit 110 facing the cable cutting unit 112 to protect the hydraulic system from the equipment used to bring and remove the payout reels 116 from the cable dispensing unit 110. This arrangement, compounded with the need to accommodate various sizes of payout reels 116, generally places the payout reel 116 some distance from the operator 126 when standing between the cable dispensing unit 110 and the cable cutting unit 112, as can be seen from FIG. 1. Therefore, the procedure for transferring a length of cable 120 from a payout reel 116 to a take-up reel 114 generally entails the following time consuming steps.

The payout reels 116 are first loaded into the cable dispensing unit 110 by an assistant operating a forklift or the like. Then, the operator 126 selects the particular payout reel 116 holding the specific size cable 120 needed consistent with a job order. The operator 126 then moves the cable cutting unit 112 laterally until it is in front of the corresponding cable dispensing unit 110. Because of the operator's location 126 it is impossible for the operator to address the payout reel 116 from the position between the dispensing unit 110 and the cable cutting unit 112 since the location of the payout reel 116 is too far away to enable the operator 126 to simply reach over and grab the end of the desired cable 120 from the payout reel 116. The operator 126 must walk around the group of four cable dispensing units 110 to the backside of the corresponding cable dispensing unit 110 and gain access to the cable end. Typically, a thermal wrap (not shown) of protecting the cable wound on the payout reel 116 from moisture, heat and ultraviolet rays must be removed from the payout reel 116 to gain access to the cable end, which is secured to the payout reel 116 by a tie-down device (not shown) or the like. The operator must then feed the cable end over the cable dispensing unit 110 in any convenient manner and return to the front of the four cable dispensing units 110. The cable 120 is then pulled, by the operator, causing the payout reel 116 to rotate to dispense the cable 120. Because the payout reel 116 is extremely heavy, considerable effort by the operator 126 is sometimes necessary to pull the cable 120 from the payout reel 116 to the cable cutting unit 112. The operator 126 then feeds the cable 120 into the cable cutting unit 112, which pulls a predetermined length of cable 120 through and collects the desired length onto the take-up reel 114 whereafter it is cutoff by the cable cutting apparatus. The operator 126 must then again walk to the backside of the cable dispensing unit 110 and rotate the payout reel 116 in reverse rotation to again collect the remaining cable 120 and secure the cable end to the payout reel 116.

From the above discussion, it can be readily appreciated that the cable dispensing units known to the prior art require considerable time and effort by the operator to transfer a desired length of cable from a payout reel to a take-up reel. Further, the prior art does not teach or suggest a cable dispensing unit which is able to reduce the distance between the operator and the payout reel in order to eliminate the need for the operator to walk between the front and backside of the cable dispensing unit. Finally, the prior art does not teach or suggest a cable dispensing unit which can accommodate various diameters of payout reels while consistently positioning the payout reel a convenient distance from the operator.

Accordingly, what is needed is a cable dispensing apparatus capable of rotatably securing and positioning a payout reel within arms length from an operator standing between the cable dispensing apparatus and a cable cutting apparatus, while also providing power driven accessories for controlling the payout reel so as to minimize the degree of effort and amount of time demanded of the operator to transfer a length of cable from the payout reel to a take-up reel.

SUMMARY OF THE INVENTION

According to the present invention there is provided a cable dispensing apparatus for dispensing a length of cable from a payout reel to a cable cutting apparatus and take-up reel in which the cable dispensing apparatus has a transfer system which both lifts and moves the payout reel toward an operator location between the cable dispensing apparatus and the cable cutting apparatus thereby eliminating the need for the operator to walk between the front and backside of the cable dispensing apparatus at least two times to complete a job. The apparatus is equipped such that the operator can remain between the cable dispensing apparatus and the cable cutting apparatus throughout the entire cable dispensing operation. The cable dispensing apparatus is capable of positioning the payout reel a predetermined distance from the front of the cable dispensing apparatus such that the free end of the cable can be positioned within arm's reach of the operator to perform the necessary function to dispense the cable to the payout reel.

The cable dispensing apparatus includes a frame from which a support device extends rearwardly in a direction away from the position of the operator and the front of the cable dispensing apparatus. The support device is constructed to rotatably support the payout reel on which the cable is collected, such as a telephone cable. Mounted to the support device is a transfer apparatus for moving the payout reel relative to the support device away from or toward the operator. Accordingly, the payout reel is rotatably supported by the support device adjacent the frame in a manner in which the payout reel can be horizontally displaced relative to the frame of the cable dispensing apparatus to position the payout reel within a convenient arm's length distance from the operator. The cable dispensing apparatus preferably includes a sensing device for sensing when the payout reel has been sufficiently moved toward the operator so as to be positioned at the desired distance from operator. The transfer device can then be stopped automatically when the outer perimeter of the payout reel is sufficiently close to the operator to allow the operator to readily remove the thermal wrap and detach the payout reel, all while remaining in front of the cable dispensing apparatus.

The support device is preferably provided as a pair of transfer devices mounted to a corresponding pair of arms which are pivotably attached to the frame so as to enable pivotal movement of the payout reel relative to the cable dispensing apparatus. Such construction allows the payout reel to be secured to the arms of the transfer device while resting on the ground and then subsequently lifted off the ground to allow the payout reel to be advanced along the transfer devices toward the operator and rotated for dispensing the cable according to the invention. The support devices themselves include a spindle, commonly referred to as a pintle, for supporting and rotatably securing the payout reel to the pair of arms. A drive motor is provided with one of the support devices for rotating the payout reel. The cable dispensing apparatus further includes a positioning device for moving the arms toward and away from each other so as to accommodate reels of differing axial widths.

According to a preferred aspect of this invention, the resulting method for dispensing the cable from the payout reel is greatly simplified, requiring considerably less time and effort by the operator in dispensing the cable. The order of steps includes having an assistant first position the payout reel between the arms extending from the backside of the cable dispensing apparatus. The operator then moves the arms together until each support device engages a corresponding side of the payout reel. The arms are then raised to lift the payout reel to a suitable height off the ground. The transfer device then moves the transfer device and the associated payout reel along the length of the arms toward the cable dispensing apparatus until the payout reel is positioned a predetermined distance from the cable dispensing apparatus and, consequently, within arms length from the operator. The operator can then rotate the payout reel with the drive motor to remove the thermal wrap and free the end of the cable by simply reaching across the cable dispensing apparatus. The cable dispensing apparatus can then be further rotated with the drive motor while the operator walks the free end of the cable over to the cable cutting apparatus and associated take-up reel. Once the cable has been fed into the cable cutting apparatus and the desired length of cable has been collected onto the take-up reel, the payout reel can be rotated in a reverse direction to rewind the remaining length of cable back onto the payout reel. The end of the cable is then secured to the payout reel and the thermal wrap is replaced for storage of the payout reel.

In addition, a significant advantage of the present invention is that virtually any size payout reel can be accommodated on the cable dispensing apparatus in that the payout reel is transferred toward the front of the cable dispensing apparatus until the sensing device triggers the transfer device to stop the forward progress of the payout reel. Accordingly, the edge of the payout reel, referred to as the flange, will be consistently positioned a predetermined distance from the operator, regardless of the size of the payout reel.

Accordingly, it is an object of the present invention to provide a cable dispensing apparatus which is able to position and rotatably support a payout reel close to an operator so as to allow the operator to remain in front of the cable dispensing apparatus during the entire operating procedure of the cable dispensing apparatus.

It is a further object of the invention that such a cable dispensing apparatus be capable of repeatably positioning the payout reel a predetermined distance from the operator so as to position the free end of a cable collected on the payout reel within arm's length of the operator.

It is still a further object of the invention that such a cable dispensing apparatus be able to both lift the payout reel off the ground and position the payout reel relative to the operator regardless of the diameter of the payout reel such that the cable dispensing device can accommodate payout reels of various sizes.

It is another object of the invention that such a cable dispensing apparatus be able to rotate the payout reel to dispense the cable from the payout reel according to the length of cable needed, and subsequently collect the remaining length of cable back onto the payout reel.

It is yet another object of the invention that such a cable dispensing apparatus employ an actuation system for positioning the payout reel, the hydraulic actuation system being located so as not to interfere with the operator's access to the payout reel.

It is still another object of the invention that such a cable dispensing apparatus reduce the time and effort demanded of the operator to complete the transfer of a length of cable from the payout reel to a take-up reel.

Other objects and advantages of the invention will be more apparent after a reading of the following detailed description taken in conjunction with the drawings provided.

DETAILED DESCRIPTION OF THE PREFERRED EMBODIMENT

Figure 1:
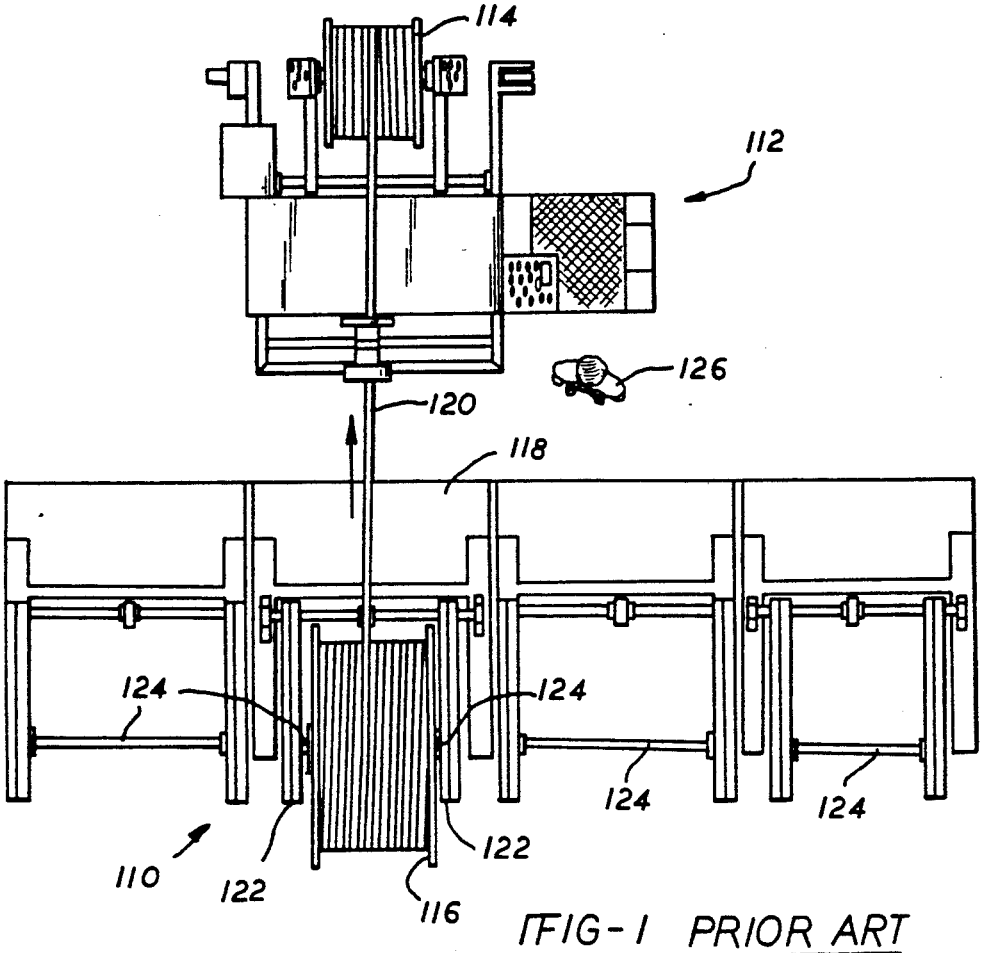
FIG-1 PRIOR ART
FIG. 1 is a plan view of a group of four cable dispensing units and a cable cutting unit known in the prior art.
Figure 2:
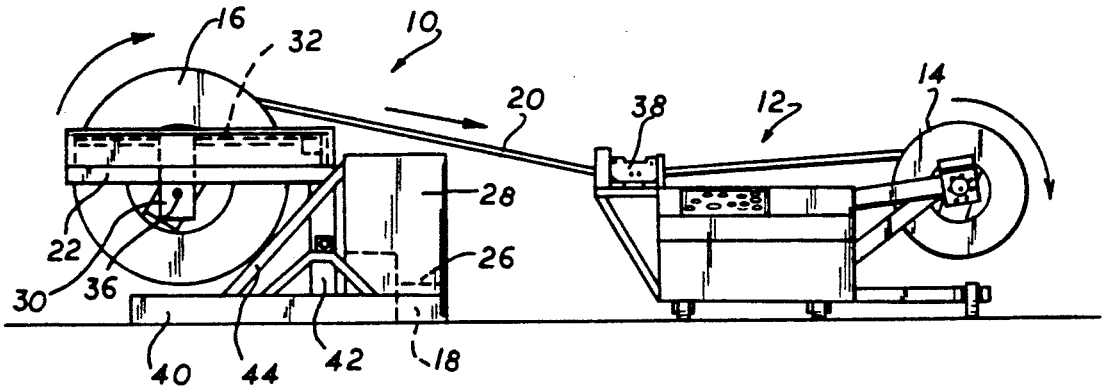
FIG. 2 is a side view of a cable dispensing apparatus in accordance with the preferred embodiment of this invention, shown in position relative to a cable cutting apparatus.

With reference to FIG. 2, there is shown a cable dispensing station having a cable dispensing apparatus 10 and a cable cutting apparatus 12. The cable dispensing apparatus 10 is shown supporting a payout reel 16 on which a cable 20, such as telephone cable, is wound. The cable 20 is shown extended through the cable cutting apparatus 12. The cable cutting apparatus 12 has a cable cutting and measuring device 38 which measures and cuts a predetermined length of cable 20. The length of cable 20 is shown being collected on a take-up reel 14 which is controlled by the cable cutting apparatus 12.

The cable dispensing apparatus 10 includes a horizontal base 40 which supports the frame of the cable dispensing apparatus 10. Extending upwardly from the base 40 is a vertical frame 42 which is braced by a pair of oppositely disposed support struts 44. Extending rearwardly from the vertical frame 42 is a pair of reel support arms 22. Supported above the reel support arms 22 is a corresponding pair of helical threaded shafts 32. Engaging both the support arms 22 and the helical shafts 32 are a corresponding pair of reel support devices 30 which are slidably driven along the length of the support arms 22 by the helical shafts 2. In turn, the helical shafts 32 are selectively rotated by corresponding shaft drive motors 34, which act to transfer the support devices 30 between distal and proximate positions from the vertical frame 42. The support devices 30 also contain a reel drive motor 36 for selectively rotating and stopping the payout reel 16. A hydraulic supply system (not shown) is conveniently stored below a set of steps 26 which serve as a hydraulic cabinet 18, while electrical switching controls are housed in an electronic control cabinet 28 positioned to one side of the steps 26.

Figure 3:
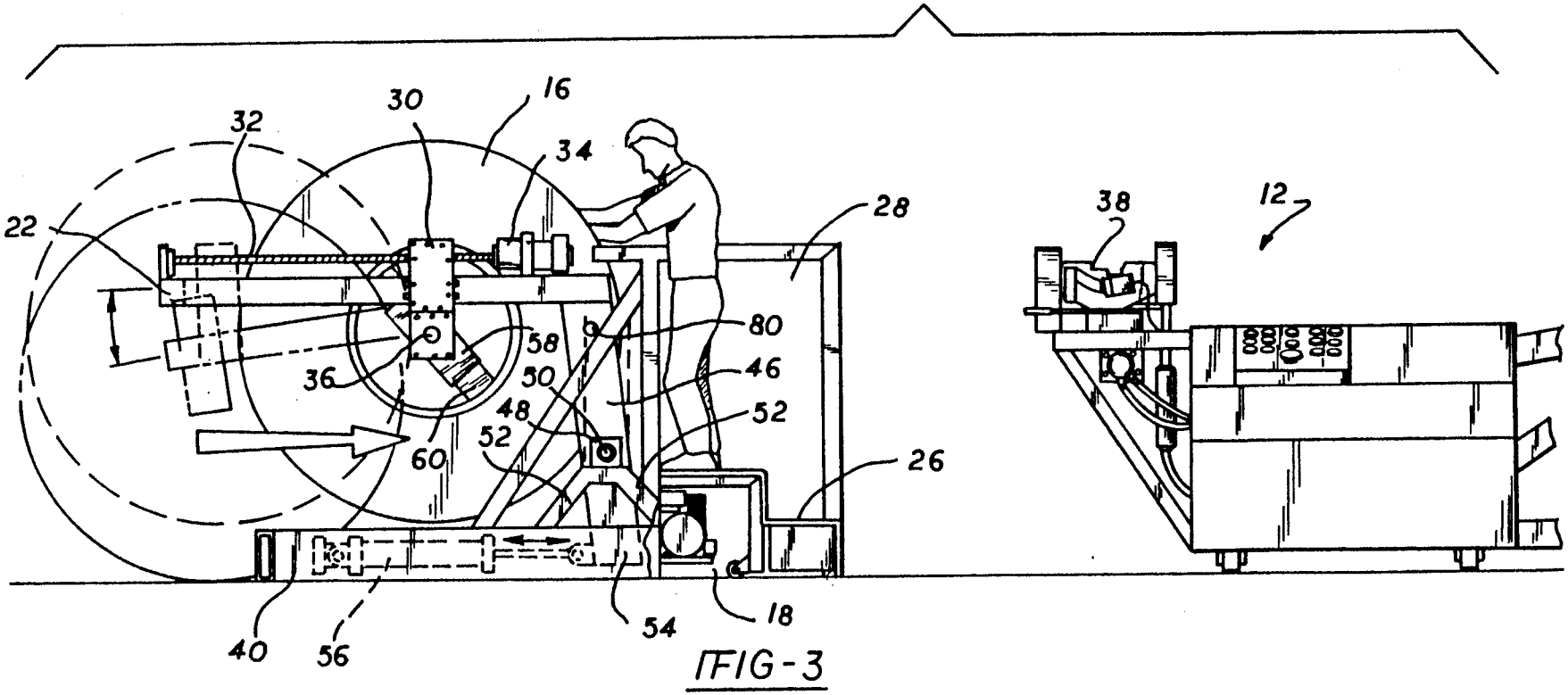
FIG. 3 is a side view of the cable dispensing apparatus of FIG. 2 shown in greater detail.

According to the preferred embodiment, the cable dispensing apparatus 10 is able to both pivot and translate the payout reel 16, as shown in FIG. 3. In a first position (left most as seen in FIG. 3) the payout reel 16 is resting on the floor immediately after being secured to the support device 30. The intermediate position shows the payout reel 16 raised off the floor and the third position (right.most as seen in FIG. 3) shows the payout reel 16 positioned a predetermined distance from the vertical frame 42 so as to be within arm's length of the operator.

The support arms 22 are pivotally attached to the cable dispensing apparatus 10 at a pair of pivots 50, each of which are supported above the horizontal base 40 by a corresponding pair of pivot arm supports 52. Each support arm 22 has a vertical support arm 45 (seen in FIG. 5) which extends downwardly from one end of each support arm 22 closest to the vertical frame 42. Each vertical support arm 45 is supported in a vertical support frame 46. Intermediately located on each vertical support frame 46 is a trundle 48 which pivotably resides in a corresponding pivot 50 to allow the support arms 22 to rotate together about the pivots 50. A lower end 54 of each vertical support frame 46 extends toward the horizontal base 40 while the upper end of each vertical support frame 46 has a horizontal slide member 80 to which each vertical support arm 45 is slidably secured. The construction and arrangement of the vertical support arm 45 and the vertical support frame 46 will be described in greater detail below. The lower ends 54 of the vertical support frames 46 are each pivotably attached to a stroking device, such as a hydraulic cylinder 56. The hydraulic cylinders 56 are each anchored to the horizontal base 40 and act to rotate the support arms 22 by pivoting the vertical support frames 46 about their respective pivots 50. Accordingly, the payout reel 16 supported in the support device 30 can be rotated between the first position illustrated in FIG. 3 in which the payout reel 16 rests upon the floor, and an intermediate position such as that illustrated in FIG. 3 in which the payout reel 16 is suspended from the support arms 22 above the floor.

To facilitate the accurate vertical displacement of the payout reel 16, it is known in the art to use sensors which are able to detect the position of an object and relay an appropriate signal to a motion control device. In the preferred embodiment of the present invention, a fiber optic device (not shown) is employed to detect the height of the payout reel 16 above the floor so as to ensure that sufficient clearance is provided to allow the payout reel 16 to rotate freely. Such a position detecting device is available from Micro Switch of Freeport, Ill., which manufactures a fiber optic control serial number FE5F-3RC6-M and receivers serial number FEF-PAD6-M which relay the position of the payout reel 16 as it passes each respective receiver. Depending upon the size of the payout reel 16, the fiber optic control device can be preprogrammed to stop the rotation of the support arms 22 such that the payout reel 16 is suspended an optimal height from the floor for its particular size and weight.

Figure 5:
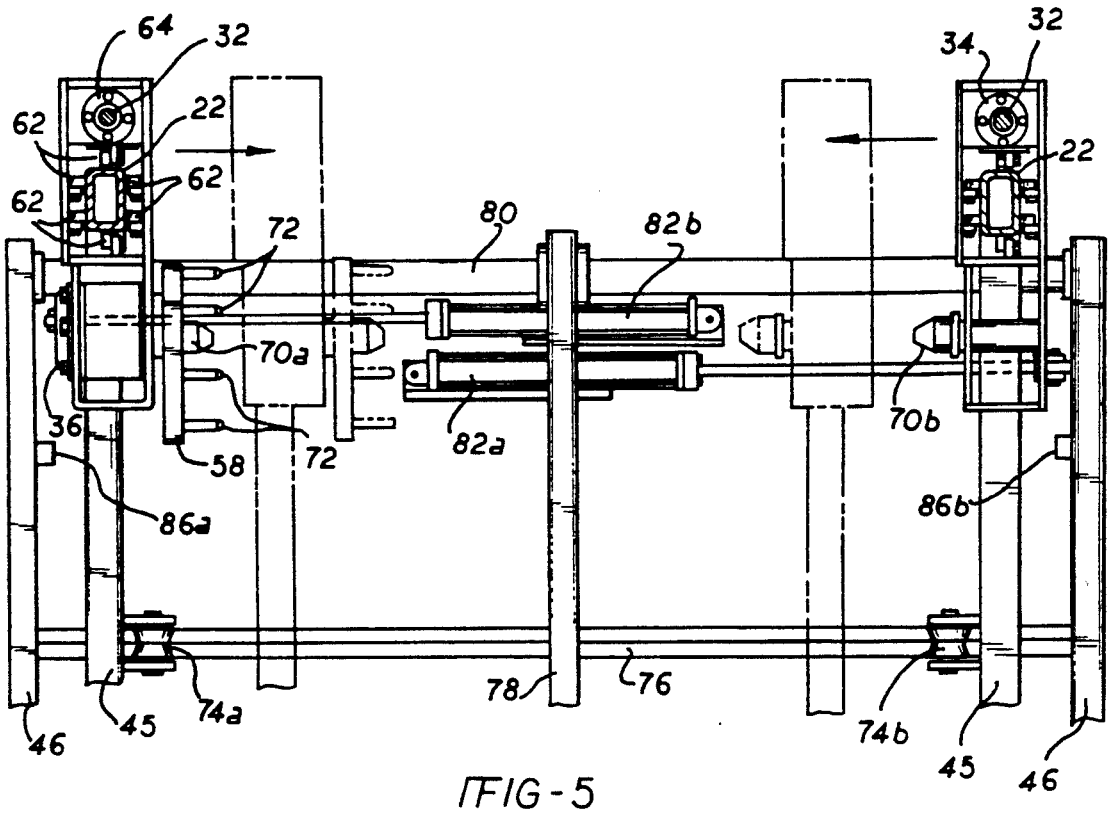
FIG. 5 is a partial cross-sectional view of the backside of the cable dispensing apparatus of FIG. 2 looking toward the operator and without the payout reel in accordance with the preferred embodiment of this invention.

Also shown in FIG. 3 is a reel brace 60 which extends diametrically across each end of the payout reel 16. The reel brace is engaged by a pintle plate 58 driven by the reel drive motor 36. As best seen in FIG. 5, the reel drive motor 36 is mounted to one of the support devices 30 (the lefthand support device 30 as viewed in FIG. 5) below the support arms 22. The pintle plate 58 is attached to a drive shaft (not shown) extending inward from the reel drive motor 36. The remaining support device 30 (the righthand support device 30 as viewed in FIG. 5) is provided with a pintle **70*b* which extends inwardly for engaging an axial bore (not shown) extending through the central axis of the payout reel 26. The pintle plate 58 is also provided with a pintle 70*a* and preferably four engagement fingers 72 which extend inwardly. The pintle 70*a* engages the axial bore of the payout reel 16 in a similar manner as does the pintle 70*b*, while the engagement fingers 72 cooperate to trap the reel brace 60 on the side of the payout reel 16 adjacent the pintle plate 58, as indicated in FIG. 3. The reel braces 60 are conventional and, therefore, no special modifications are required to adapt the payout reel 16 to the support device 30 and the pintle plate 58**.

With reference again to FIG. 5, the support devices 30 are slidably engaged upon the support arms 22 by several pairs of roller members 62. As illustrated, preferably three pairs of roller members 62 are employed for each support device 30. A first pair is oppositely disposed on an upper and lower surface of each support arm 22, while the remaining two pairs are oppositely disposed along the sides of each support arm 22. The roller members 62 are constructed in terms of material strength and hardness to withstand the significant loads associated with a fully laden payout reel 16, which is often as much as 20,000 pounds. In addition, the roller members 62 must roll freely in order to avoid undue loading on the helical shaft 32 and shaft drive motor 34, which will be described more fully below.

Also illustrated in FIG. 5 is the method in which the vertical support arms 45 are mounted to their respective vertical support frames 46. As previously noted above, each vertical support arm 45 is slidably disposed over the horizontal slide member 80 which extends between and is attached to each vertical support frame 46. This arrangement allows the vertical support arms 45, and thus the support arms 22 to which the vertical support arms 45 are rigidly attached, to slide laterally between the vertical support frame 46. To facilitate the sliding action, each vertical support arm 45 is provided with a rail roller member **74*a* and 74*b* which engages a rail 76 extending between and attached to each vertical support frame 46 below the horizontal slide member 80. A vertical rail support 78 is positioned intermediate the vertical support frames 46 to provide structural rigidity to the rail 76 and the horizontal slide member 80. The vertical rail support 78 also serves to mount a pair of hydraulic cylinders 82*a* and 82*b* which act to actuate their respective vertical support arms 45 inwardly toward the vertical rail support 78 and outwardly toward the vertical support frames 46. Accordingly, the support arms 22 can be adjusted laterally to accommodate payout reels 16** of various axial widths.

Figure 4:
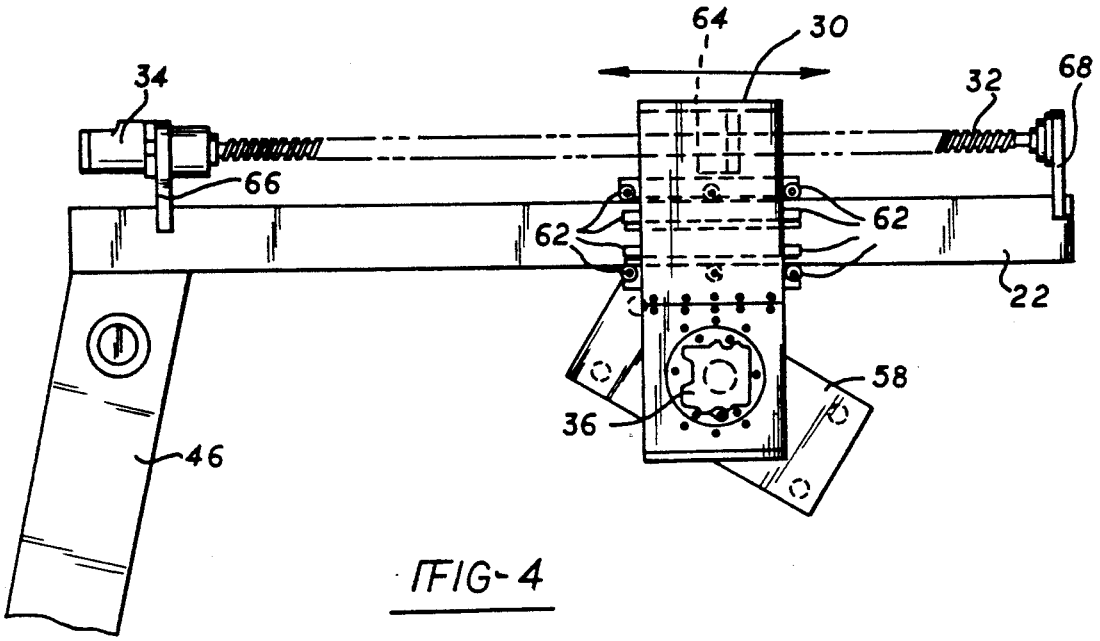
FIG. 4 is a detailed partial side view of the opposite support arm of the cable dispensing apparatus of FIGS. 2 and 3 showing the support and transfer devices in accordance with the preferred embodiment of this invention.

Shown in FIG. 4 is the reel drive motor 36 which serves to rotate the payout reel 16 with respect to the support devices 30. Preferably, the reel drive motor 36 is a hydraulically-driven motor suitable for manufacturing conditions. The reel drive motor 36 is bi-directional so as to be able to rotate the payout reel 16 in one direction for dispensing the cable 20 and a reverse direction for collecting the cable 20 onto the payout reel 16. The reel drive motor 36 also has a neutral mode which allows the payout reel 116 to free-wheel when the cable 20 is pulled by the operator or the cable cutting apparatus 112. Switching devices (not shown) for reversing the operation of the reel drive motor 36 are well known in the art and can readily be adapted for this purpose.

An additional feature which is well known to those skilled in the art is to provide a braking mechanism (not shown) associated with the reel drive motor 36. Preferably, such a braking mechanism would be engagable to securely lock the payout reel 16 in a desired position while also being capable of providing rotational drag for creating tension in the cable 20 while it is being drawn through the cable cutting and measuring device 38. Such a feature would prevent the payout reel 16 from excessively free-wheeling as a result of sudden interruptions while the cable 20 is being pulled.

Illustrated in greater detail in FIG. 4 is one of the helical shafts 32 by which a corresponding one of the support devices 30 is transferred toward and away from the vertical frame 42. The helical shaft 32 is supported above the support arm 22 by a helical shaft support 68 mounted at the distal end of the support arm 22 and a drive motor support 66 which is mounted to the support arm 22 adjacent the vertical support frame 46. Also mounted to the drive motor support 66 is the shaft drive motor 34 by which the helical shaft 32 is rotated. The shaft drive motor 34 can be of any suitable motor unit which is sufficiently rugged for operation in manufacturing conditions, such as a hydraulically-powered drive motor as previously noted with the reel drive motor 36.

The support device 30 envelopes both the support arm 22 and the helical shaft 32. Mounted within the support device 30 and threadably engaging the helical shaft 32 is a female helical member 64 as shown in FIGS. 4 and 5. The female helical member 64 is rigidly supported within the support device 30 such that rotation of the helical shaft 32 results in the translation of the support device 30 along the length of the helical shaft 32 according to the direction of rotation of the helical shaft 32. Each of the helical shafts 32 is simultaneously rotated by their corresponding shaft drive motors 34 to translate the support devices 30, and thus the payout reel 16, between a distal position adjacent the helical shaft support 68 and furthest from the vertical support frame 46, and a proximate position adjacent to the drive motor support 66 and closest to the vertical support frame 46.

Correspondingly, a significant advantage of the cable dispensing apparatus 10 of the present invention is that, as illustrated in FIG. 3, the distal position of the support devices 30 supports the payout reel 16 at a maximum distance from the operator, allowing the payout reel 16 to be easily loaded into the cable dispensing apparatus 10, while the proximate position brings the payout reel 16 within arm's length of the operator. As with the reel drive motor 36, switching devices for reversing the operation of the shaft drive motor 34 are well known in the art and can readily be employed for reversing the rotation of the shaft drive motor 34 for selectively translating the payout reel 16 between the two extreme positions described.

Another significant advantage of the present invention is that the motion control of the support devices 30 via the shaft drive motor 34 provides for additional automation of the loading procedure for the payout reel 16. With reference again to FIG. 5, a sensing device 86*a* and 86*b* can be seen in profile attached to the inner surfaces of the vertical support frame 46. The sensing devices 86*a* and 86*b* can be any conventional switch capable of sensing the position of an object and relaying a signal to other devices which can operate on that signal. However, it is preferable to employ a photoelectric switch which directs an infrared light beam from a sending unit 86*a* to a receiving unit 86*b*. The accuracy and repeatability of the infrared light beam ensures that the payout reel 16 will be accurately positioned at a predetermined distance from the operator such that, as each new payout reel 16 is loaded into the cable dispensing apparatus 10, the payout reel 16 will be consistently brought within arm's length of the operator. An example of such a preferred photoelectric switch is photoelectric control serial number FE7D-RPR7-M and target serial number FE-RR1, manufactured by Micro Switch of Freeport, Ill.

Accordingly, the present invention provides a cable dispensing apparatus 10 which is able to dispense the cable 20 from the payout reel 16 following a greatly simplified procedure, requiring considerably less time and effort by the operator. The payout reel 16 can first be positioned between the support arms 22 by any suitable device, such as a specially adapted forklift which is operated by an assistant. Operating the cable dispensing apparatus 10 from between the cable dispensing apparatus 10 and the cable cutting apparatus 12, the operator can then actuate the hydraulic cylinders 82*a* and 82*b* to bring the support arms 22 together until the support device 30 of each support arm 22 is engaged with a corresponding axial bore of the payout reel 16. Accurate control and positioning of the support arms 22 is achieved by vertical adjustments of the support arms with the hydraulic cylinders 56 and forward and rearward adjustment of the support devices 30 with the shaft drive motors 34. The payout reel 16 can then be securely engaged with the support devices 30, rotating the pintle plate 58 if necessary to align the engagement fingers 72 with the reel brace 60.

Once secured to the support arms 22, the payout reel 16 can be raised off the floor by rotating the support arms 22 until a suitable height is attained. By using a sensing device such as the fiber optic device described above, the height of the payout reel 16 can be accurately controlled. The shaft drive motor 34 is then energized to move the support devices 30, along with the payout reel 16, toward the front of the cable dispensing apparatus 10 until the payout reel 16 is positioned a predetermined distance from the operator. As an added feature, by employing the aforementioned fiber optic device, an additional signal can be relayed to the hydraulic actuation circuitry controlling the shaft drive motors 34 to automatically initiate translation of the payout reel 16 toward the operator once the payout reel has reached the desired height.

The operator can then rotate the payout reel 16 with the reel drive motor 36 to facilitate removal of the thermal wrap and to expose the end of the cable 20. Provided with a suitable predetermined distance, such as 8 to 10 inches from the payout reel 16 to the front edge of the cable dispensing apparatus 10, the operator can easily reach across the cable dispensing apparatus 10 to free the end of the cable 20 from the payout reel 16, and thereafter initiate further rotation of the payout reel 16 while walking the free end of the cable 20 over to the cable cutting apparatus 12. Once the cable 20 has been fed into the cable cutting apparatus 12 and the desired length of cable 20 has been collected on the take-up reel 14, the payout reel 16 can be rotated in a reverse direction with the reel drive motor 36 to collect the remaining length of cable 20 onto the payout reel 16.

A significant advantage of the above procedure is that the operator need never walk behind the cable dispensing apparatus to adjust the payout reel 16 or grasp the free end of the cable 20. With the teachings of the present invention, the free end of the cable 20 can be brought within arm's length of the operator entirely by controlling the position of the payout reel 16 from a control unit (not shown) located conveniently near the operator. In addition, any conventionally sized payout reel 16 can be accommodated with the cable dispensing apparatus 10 of the present invention in that the payout reel 16 is translated toward the operator until the sensing device 86*a* and 86*b* triggers the shaft drive motor 34 to stop the forward progress of the support devices 30 and the payout reel 16. Accordingly, the payout reel 16 is consistently positioned a predetermined distance from the operator regardless of the size of the payout reel 16.

While the invention has been described in terms of a preferred embodiment, it is apparent that other forms could be adopted by one skilled in the art. For example, other devices for translating the payout reel 16 toward the operator can be employed other than the helical shaft 32 and the hydraulic shaft drive motor 34 disclosed. In addition, the procedure for securing the payout reel 16 to the cable dispensing apparatus 10 can be modified while still employing the specific step of transferring the payout reel 16 toward the operator. Accordingly, the scope of the invention is to be limited only by the following claims.

What is claimed is:

1. A cable dispensing apparatus for dispensing a cable from a reel, said cable dispensing apparatus comprising:

a frame adapted to receive said reel therein;

support means disposed adjacent said frame for rotatably supporting said reel, said support means comprising a pair of arms pivotably attached to said frame so as to provide pivotal movement of said reel relative to said frame;

means, mounted to said support to said support means, for traversing said support means, said traversing means adapted to move in a direction toward or away from said frame; and positioning means for moving said pair of arms toward and away from each other so as to accommodate reels of differing widths;

whereby said reel is rotatably supported by said support means adjacent said frame, said reel being displaceable relative to said frame by said means for traversing so as to position said reel a predetermined distance from said frame.

2. The cable dispensing apparatus of claim 1 wherein said support means further comprises a spindle for supporting and securing said reel to said pair of arms, drive means for rotating said spindle and said reel together, and braking means for providing frictional resistance to rotation of said reel.

3. The cable dispensing apparatus of claim 1 further comprising sensing means for indicating when said reel is said predetermined distance from said frame during travel of said reel toward said frame.

4. A cable dispensing apparatus for dispensing a cable from payout reels having differing diameters and transferring said cable to a take-up reel, said cable dispensing apparatus comprising:

a frame having a backside and an oppositely disposed front side, said front side facing said take-up reel;

a pair of arms extending rearwardly from said backside of said frame, each arm of said pair of arms having support means for rotatably supporting said payout reel, said pair of arms being pivotably attached to said frame so as to provide pivotal movement of said payout reel relative to said frame for accommodating payout reels of differing diameters;

means for traversing each said support means along a respective arm of said pair of arms in a direction toward or away from said frame; and positioning means for moving said pair of arms toward and away from each other so as to accommodate payout reels of differing widths;

whereby said payout reel is rotatably supported by said support means adjacent said frame, said payout reel being displaceable relative to said frame by said means for traversing so as to position said payout reel a predetermined distance from said frame.

5. The cable dispensing apparatus of claim 6 further comprising:

a spindle for supporting and securing said payout reel to said pair of arms, said spindle having a drive means adapted to communicate with said support means, said drive means rotating said spindle and said payout reel together; and a braking means juxtaposed said payout reel out providing friction resistance to rotation of said payout reel.

6. The cable dispensing apparatus of claim 5 further comprising sensing means mounted to said frame for sensing when said payout reel is said predetermined distance from said frame during travel of said payout reel toward said frame, said sensing means relaying a signal to said drive means to arrest travel of said payout reel once said payout reel is said predetermined distance from said frame.

7. The cable dispensing apparatus of claim 6 wherein said sensing means comprises an optical sensor for sensing when said payout reel has traveled said predetermined distance toward said frame.

8. The cable dispensing apparatus of claim 4 wherein said means for traversing comprises:

a helical screw disposed substantially parallel to each arm of said pair of arms;

a drive attached to said frame for rotating said helical screw; and an internally threaded member threadably engaging said helical screw and attached to said support means;

whereby rotation of said helical screw traverses said support means along said helical screw to selectively move said payout reel toward or away from said frame.

9. The cable dispensing apparatus of claim 8 further comprising sensing means mounted to said frame for sensing when said payout reel is said predetermined distance from said frame during travel of said payout reel toward said frame, said sensing means relaying a signal to said drive means to arrest travel of said payout reel toward said frame once said payout reel is said predetermined distance from said frame.

10. The cable dispensing apparatus of claim 4 wherein said means for traversing has a first position for positioning said payout reel a maximum distance from said frame and a second position for positioning said payout reel said predetermined distance from said frame, whereby said payout reel is mounted to said support means when said means for traversing is in said first position and said cable is dispensed from said payout reel when said means for traversing is in said second position.

11. A method for dispensing cable from a payout reel, said method comprising the steps of:

positioning said payout reel between a pair of pivotal support arms extending from one side of a non-mobile cable dispensing apparatus having a fixed operator platform located at an opposite side;

moving said pair of pivotal support arm until each arm of said pair of pivotal support arms is adjacent a respective side of said payout reel;

rotatably engaging said payout reel with linearly movable support means mounted to each arm of said pair of pivotal support arms;

lifting said payout reel with said pair of pivotal support arms to a predetermined height;

upwardly rotating said pair of pivotal support arms relative to said non-mobile cable dispensing apparatus;

sensing the rotational position of said pivotal support arms;

automatically moving, based on said sensed rotational position, said payout reel along said linearly movable support means toward said fixed operator platform to position said payout reel a predetermined distance from said fixed operator platform; and dispensing said cable from said payout reel by rotating said payout reel and directing said cable to said opposite side of said non-mobile cable dispensing apparatus such that an operator standing on said fixed operator platform can direct said dispensed cable onto a take-up reel located along said opposite side of said non-mobile cable dispensing apparatus.

12. A method for dispensing cable from a payout reel, said method comprising the steps of:

positioning said payout reel adjacent one side of a non-mobile cable dispensing apparatus having a fixed operator platform at an opposite side and a pair of pivotal support arms mounted on said one side between said payout reel and said fixed operator platform;

positioning said payout reel between said pair of pivotal support arms;

securing said payout reel to a linearly movable support means positioned on said pair of pivotal support arms and straddling said payout reel on said one side of said non-mobile cable dispensing apparatus;

first moving said payout reel along said linearly movable support means toward said fixed operator platform to position said payout reel a predetermined distance from said fixed operator platform;

dispensing said cable from said payout reel by rotating said payout reel and directing said cable to said opposite side of said non-mobile cable dispensing apparatus such that an operator standing on said fixed operator platform can direct said dispensed cable onto a take-up reel located along said opposite side of said non-mobile cable dispensing apparatus;

upwardly rotating said pair of pivotal support arms relative to said non-mobile cable dispensing apparatus to support said payout reel after said securing step;

second moving said pair of arms to rotatably engage said linearly movable support means with said payout reel after said steps of positioning said payout reel between said pair of pivotal supports arms; and initializing said second moving step automatically after said upwardly rotating step.

* * * * *